US008794480B2

(12) United States Patent
Gollnick et al.

(10) Patent No.: US 8,794,480 B2
(45) Date of Patent: Aug. 5, 2014

(54) CONTAINER, A TRANSPORT UNIT FORMED BY THE LATTER, AND A CONTAINER SYSTEM

(75) Inventors: Volker Gollnick, Apensen (DE); Omar Abd El Hakam, Hamburg (DE)

(73) Assignee: Deutsches Zentrum für Luft—und Raumfahrt e.V., Köln (DE)

( * ) Notice: Subject to any disclaimer, the term of this patent is extended or adjusted under 35 U.S.C. 154(b) by 68 days.

(21) Appl. No.: 13/263,868

(22) PCT Filed: Oct. 20, 2010

(86) PCT No.: PCT/EP2010/065829

§ 371 (c)(1), (2), (4) Date: Oct. 11, 2011

(87) PCT Pub. No.: WO2011/054675

PCT Pub. Date: May 12, 2011

(65) Prior Publication Data

US 2012/0024740 A1 Feb. 2, 2012

(30) Foreign Application Priority Data

Nov. 3, 2009 (DE) ..... 10 2009 051 795

(51) Int. Cl.
*B65D 43/03* (2006.01)

(52) U.S. Cl.
USPC ..... 220/781; 220/1.5; 206/512

(58) Field of Classification Search
USPC ..... 220/23.6, 1.5, 380, 781, 4.26, 4.27; 206/203, 504, 506, 509, 511, 512
See application file for complete search history.

(56) References Cited

U.S. PATENT DOCUMENTS

| | | | | | |
|---|---|---|---|---|---|
| 2,869,750 | A | * | 1/1959 | Doerr et al. | 220/4.28 |
| 2,919,826 | A | * | 1/1960 | Richter | 220/1.5 |
| 3,083,670 | A | * | 4/1963 | Harlander et al. | 410/85 |
| 3,221,921 | A | * | 12/1965 | Silverman | 220/232 |
| 3,389,663 | A | * | 6/1968 | Gutridge | 410/82 |
| 3,456,967 | A | * | 7/1969 | Hulverson et al. | 24/287 |
| 3,480,174 | A | | 11/1969 | Sherwood | |
| 3,556,456 | A | * | 1/1971 | Lunde | 410/84 |
| 3,593,387 | A | * | 7/1971 | Georgi | 410/82 |
| 3,691,595 | A | * | 9/1972 | Backteman et al. | 24/287 |
| 3,718,218 | A | * | 2/1973 | Shields | 220/23.2 |
| 3,752,511 | A | * | 8/1973 | Racy | 24/287 |
| 3,894,493 | A | * | 7/1975 | Strecker | 24/287 |
| 3,973,684 | A | * | 8/1976 | Di Martino | 206/512 |

(Continued)

FOREIGN PATENT DOCUMENTS

| | | |
|---|---|---|
| DE | 26 17 582 | 11/1977 |
| DE | 197 15 910 | 10/1997 |
| DE | 20 2008 005 946 | 7/2008 |
| WO | 03/070604 | 8/2003 |

*Primary Examiner* — Fenn Mathew
*Assistant Examiner* — Christopher McKinley
(74) *Attorney, Agent, or Firm* — Clark & Brody

(57) ABSTRACT

The invention relates to a container (1) for intermodal transport by air and ship, train and/or motor car, comprising a block-shaped housing (2), which is characterized in that there are provided at the corners of the housing (2) castings (6) which are used for positioning when stacking the container (1) and/or for securing the container (1) during transport, and a plurality of containers (1) can be combined to form transport units (25) the base area of which corresponds to that of a standardized sea cargo container.

22 Claims, 18 Drawing Sheets

(56) References Cited

U.S. PATENT DOCUMENTS

Figure 1:
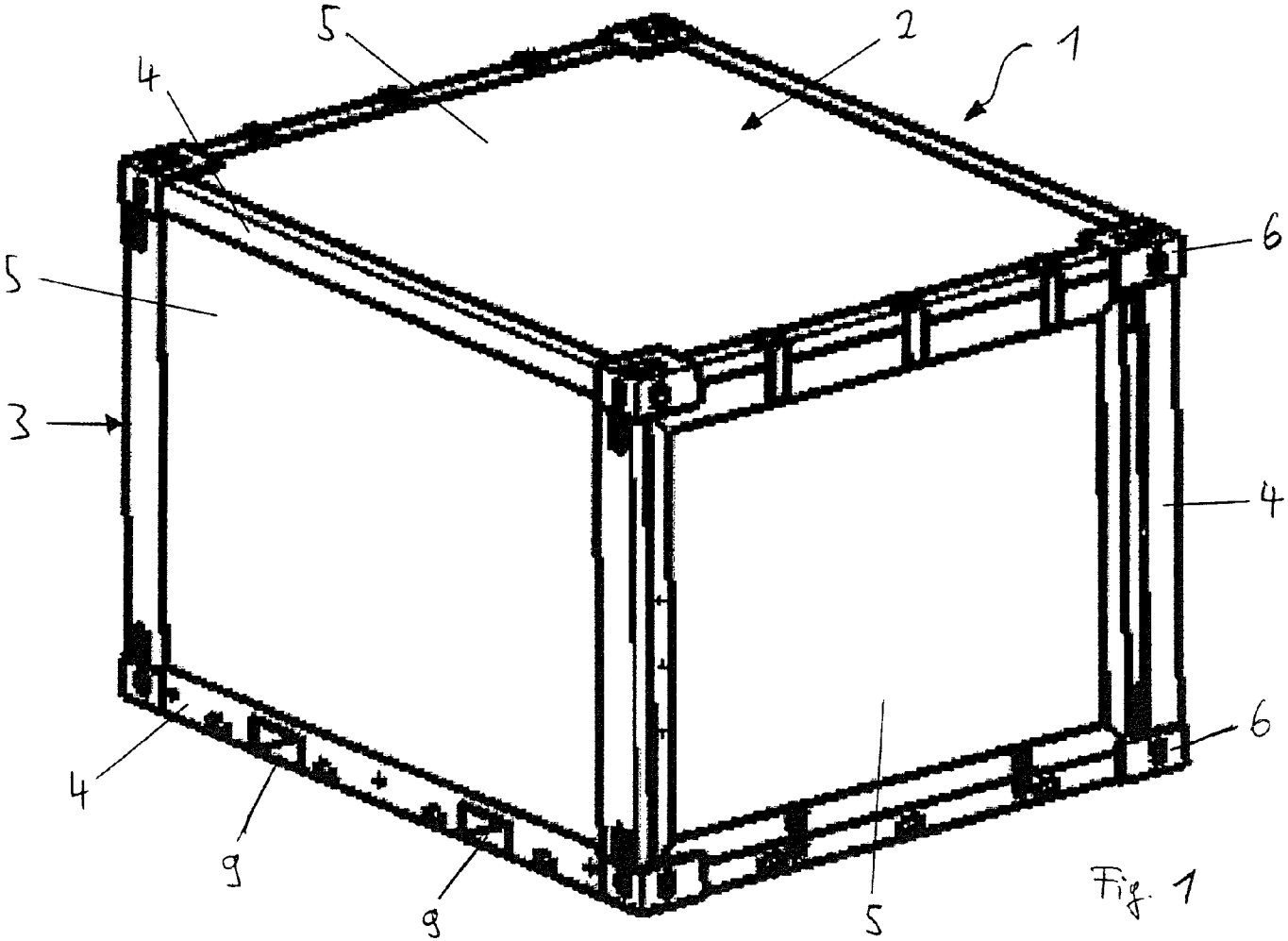

| | | | | | |
|---|---|---|---|---|---|
| 3,980,185 | A | * | 9/1976 | Cain | 206/509 |
| 4,082,052 | A | * | 4/1978 | Looks | 410/82 |
| 4,108,326 | A | | 8/1978 | Bertolini | |
| 4,125,077 | A | * | 11/1978 | Baaso | 410/82 |
| 4,155,452 | A | * | 5/1979 | Wettermann et al. | 206/512 |
| 4,212,251 | A | * | 7/1980 | DiMartino | 24/287 |
| 4,221,515 | A | * | 9/1980 | Brown et al. | 410/32 |
| 4,277,212 | A | * | 7/1981 | Rosaia | 410/78 |
| 4,564,984 | A | * | 1/1986 | Takaguchi | 24/287 |
| 4,626,155 | A | * | 12/1986 | Hlinsky et al. | 410/82 |
| 4,697,967 | A | * | 10/1987 | Schulz et al. | 410/82 |
| 4,732,505 | A | * | 3/1988 | Gloystein | 403/14 |
| 4,741,449 | A | * | 5/1988 | Bersani | 220/1.5 |
| 4,782,561 | A | * | 11/1988 | Hayama | 24/287 |
| 4,856,150 | A | * | 8/1989 | Johnson | 24/287 |
| 4,993,125 | A | * | 2/1991 | Capron et al. | 24/287 |
| 5,193,253 | A | * | 3/1993 | Janke et al. | 24/287 |
| 5,676,271 | A | * | 10/1997 | Reynard | 220/1.5 |
| 6,113,305 | A | * | 9/2000 | Takaguchi | 403/321 |
| 6,334,241 | B1 | * | 1/2002 | Flodin | 24/287 |
| 6,336,765 | B1 | * | 1/2002 | Watanabe | 403/325 |
| 6,692,203 | B2 | * | 2/2004 | Kim et al. | 410/69 |
| 6,725,507 | B2 | * | 4/2004 | Reynard | 24/287 |
| 7,000,765 | B2 | * | 2/2006 | Hase et al. | 206/503 |
| 7,014,234 | B2 | * | 3/2006 | Walker | 294/81.53 |
| 7,231,695 | B2 | * | 6/2007 | Park | 24/287 |
| 7,621,414 | B2 | * | 11/2009 | Bederke | 220/1.5 |
| 8,177,463 | B2 | * | 5/2012 | Walker | 410/84 |
| 2003/0006233 | A1 | * | 1/2003 | Reynard | 220/23.4 |
| 2003/0164375 | A1 | * | 9/2003 | Neufingerl | 220/23.4 |
| 2003/0214143 | A1 | * | 11/2003 | Walker | 294/81.53 |
| 2005/0229820 | A1 | | 10/2005 | Reynard | |

* cited by examiner

CONTAINER, A TRANSPORT UNIT FORMED BY THE LATTER, AND A CONTAINER SYSTEM

The present invention relates to a container for intermodal transport by air and ship, train and/or motor vehicle, comprising a block-shaped housing, a transport unit for intermodal transport, the base area of which corresponds to that of a standardised sea cargo container, and a container system suitable for intermodal transport.

The transport flows which are growing across the world due to the increasing exchange of goods and the rising number of internationally linked operations require efficient transport of goods to be conveyed. For this purpose it is important not only to improve transport by individual modes of transport, but also to combine the advantages of transport by different modes of transport in order to improve goods transport overall. It has thus been established to use standardised sea cargo containers (ISO 668) for sea transport over large distances. Due to the standardised dimensions, it is easy to load these containers. In addition, the sea cargo containers have standardised corner castings with which it is easy to stack and secure the containers. Thus, with ship transport using today's conventional container ships, a number of thousand containers can be loaded in a short period of time and be transported over large distances.

For transport to and from the port it is necessary to reload the containers. By taking into account the requirements according to ISO 668 for the configuration of further modes of transport the standardised sea cargo containers can be reloaded quickly onto lorries, railway carriages or even smaller cargo ships, and be conveyed further, in particular for internal traffic. However, time consuming opening of the sea cargo containers in order to reload the goods being transported within the latter is not required.

This system has proved to be of value for sea and land transport, however it is desirable to include air transport in order to accelerate the transportation of goods. However, sea cargo containers are not suitable for air transport from a practical point of view. This is first of all because the dimensions of the flight deck within the aircraft are predominantly not suitable for accommodating sea cargo containers. Even if a flight deck is in principle suited to accommodate a sea cargo container, only a few aircraft, such as e.g. the cargo version of the Boeing 747 with a fold-up nose, have loading openings to enable the loading of a sea cargo container. In addition, the stability requirements of sea cargo containers are very stringent, and so the latter have a high empty weight. The high empty weight reduces the available loading capacity which is small in aircraft, and so increases transport costs.

It is therefore normal nowadays to package goods for air transport in air cargo containers which are especially designed for air transport. As a result, it is necessary to repack the goods, for example into sea cargo containers, before and after the air transport. This process is extremely time consuming, and so the advantage of the rapid air transport is partially eliminated. Advantages arising in principle from combined sea and air transport can not be realised due to the reloading.

Repacking of the goods is also considered to be unfavourable, for example when dealing with fragile, environmentally sensitive, dangerous or particularly valuable goods. The repacking increases the risk of damage, the release of hazardous substances or loss. When repacking food, further guidelines with regard to hygiene and refrigeration must also be observed, and in particular the cold chain must not be broken.

In the prior art containers for intermodal air and land traffic are known which, however, only meet the requirements for air and also sea transport to a limited extent. The dimensions of these intermodal containers do correspond to those of sea cargo containers, but their empty weight and so their stability has been reduced in comparison to sea cargo containers. This leads to reduced weight loading of the intermodal containers. Also, a maximum of one standardised sea cargo container can be stacked during sea transport. In order to limit mechanical stress to which the intermodal containers are subjected by the movement of a ship, as occurs particularly in rough sea conditions, and due to the risk of contact with salt water, the use of these containers is only allowed in below-deck storage spaces, and this means a further restriction in comparison to the standardised sea cargo containers. These guidelines are to be taken into account when loading the transport ship and complicate the logistics.

There are also restrictions for intermodal containers for air transport. Due to their dimensions they are only suitable for use in a few particularly large cargo aircraft, such as e.g. the aforementioned Boeing 747, and so use for example as an additional load in passenger aircraft is not possible. Despite the weight which is reduced in comparison to sea cargo containers, their empty weight is high, due to which the transport costs for air transport are increased in comparison to air cargo containers. Due to the small proliferation of intermodal containers, most airports are not equipped for their use, and so intermodal containers can only be used at selected airports.

Proceeding from the aforementioned prior art it is therefore an object of the present invention to specify a container, a transport unit and a transport system of the aforementioned type which can be used universally with all modes of transport, and in particular meets the special requirements for air transport.

This object is achieved with the container of the aforementioned type in that there are provided at the corners of the housing castings which are used for positioning when stacking the container and/or for securing the container during transport, and a plurality of containers can be combined to form transport units, the base area of which corresponds to that of a standardised sea cargo container. Moreover, this object is achieved by a transport unit which is formed from a plurality of containers fastened to one another. Furthermore, this object is achieved by a container system that comprises a plurality of containers and/or transport units.

It is therefore the basic idea of the present invention to provide individual containers which are of a size suitable for air transport and can be used with existing transport aircraft or also on the cargo decks of conventional passenger aircraft. For transport by ship, railway or lorry the containers are combined to form transport units, as are used as standard for transportation by these modes of transport. Therefore the containers fulfil separately the requirements for air transport, in particular as regards size and weight, so as to be able to make efficient use of the cargo space of different aircraft types. The already existing infrastructure can also be further used for the handling of these containers. By combining to form transport units, units are provided which fulfil the requirements for transport by ship, railway and/or lorry, in particular with regard to stackability and securing for transport. It is therefore possible to deliver and further convey the containers as combined transport units by the normal, standardised modes of transport, and the infrastructure provided for these transport units can be further used without making any changes.

For the distribution of goods containers from different aircraft can be combined to form one transport unit for further conveyance together. It is also possible during the further conveyance to separate a transport unit and to combine the containers with other containers such as to form new transport units. The containers thus favour the distribution and further conveyance of quantities of goods being transported which are small in comparison to the sea cargo container. The configuration of each individual container with castings at each corner ensures that the containers can be combined with one another in any way and so can be used flexibly. The transport units can also be formed in a short time.

Due to the dimensions of the currently used aircraft, the configuration of the containers with a base area of substantially 3029 mm×2438 mm or 2019 mm×2438 mm is particularly advantageous. Then either two or three containers can be combined to form a transport unit with the standard length of 20 feet. The individual containers are suitable for air cargo, and the formation of transport units, which are geometrically compatible with sea cargo containers, is possible in a short time because only two or three individual containers are to be connected. Slightly reduced dimensions in the direction of connecting the containers can be provided in order to facilitate the handling of the containers when positioning and connecting due to a slight play.

Advantageously the containers are 2108 mm or 1626 mm high. These heights are coordinated for use in the main or lower deck of today's conventional aircraft so that the containers can essentially be transported in any aircraft. The minimum height of 2438 mm specified according to ISO 668 is not achieved, which does not, however, mean any restriction for the stackability of the connected transport units. What matters first and foremost is that no maximum dimensions are exceeded so as to enable transport in particular by road or rail. Correspondingly, the transport units with reduced height are also suitable for normal transport in the same way as for the standard sea cargo containers.

In a further advantageous embodiment of the invention the housing can have a support frame and plate-shaped wall elements attached to the latter. The support frame provides the housing with sufficient stability so that it is also possible to stack further containers/transport units without damaging the container. The walls are usually only stressed to a small extent, and so the wall elements provide sufficient protection and sealing of the container. Depending on the configuration of the container provision can be made to provide additional seal elements between the support frame and the wall elements, for example in order to seal the container against the penetration of sea water.

Furthermore, connection means for fastening the housing onto housings of adjacent containers can be provided. The connection means can be formed in different ways, and must guarantee secure connection of the individual containers to one another. For example, the connection means can be in the form of screw-on bridge elements, as are partially used nowadays to secure stacks for shipping. The bridge elements engage in adjacent corner castings and connect the containers to one another after screwing on. In one particularly advantageous embodiment of the invention the connection means are provided on the housing so that it is not necessary to provide and have available separate connection means. This facilitates handling.

Furthermore, the connection means can comprise locking elements and recesses which are provided on the housing such that the locking elements and recesses of containers positioned next to one another can be engaged with one another. One can bring about engagement of the locking elements and recesses easily and quickly.

In particular, the locking element can be in the form of a locking lever which can be moved by rotating about its longitudinal axis between a securing position, in which it is held securely axially, and an adjusting position, in which is can be displaced in the direction of its longitudinal axis between an individual position, in which it is positioned within the outer dimensions of the housing, and a connection position, in which it can be engaged with the recess of the housing of an adjacent container, in order to bring about locking with the latter. In the adjusting position the locking lever can be displaced in the axial direction between the individual position and the connection position. In order to connect the housings of adjacent containers the locking lever is displaced into the connection position, it being introduced into the engagement region of an adjacent container. By then turning into the securing position the locking lever is secured in order to avoid unintentional separation of the connected containers. When the locking lever is in the individual position, the containers or transport units to be connected can be positioned next to one another. It is easy to bring about the displacement and turning of the locking elements, and so connection of the containers can be established or broken in a short time.

In a further embodiment of the invention there can be provided on the locking lever an engagement element, in particular in the form of an elongate plate, which can be guided in the adjusting position through the recess and engages behind it in the securing position. The engagement element is arranged here such that it can be guided through the recess by rotating the locking lever into the adjusting position. In the securing position the engagement element is turned towards the recess and fixed in the latter.

A stop element can also be provided on the locking lever and be positioned such that when it reaches the connection position and/or the individual position it comes to rest against a stop surface in order to restrict the displacement path of the locking lever. Thus, for example, a movement of the locking lever can be restricted by the recess in order to achieve engagement substantially without any play. Moreover, the individual and/or the connection position can be defined by the stop surfaces so that the locking lever can easily be displaced into the respective position.

Advantageously there is provided on the locking lever an actuating lever by means of which the locking lever can be moved. This makes it possible to apply large forces in order to bring about secure connection of the housings of adjacent containers. In this way small tolerances can be compensated when positioning the containers. Despite the size and the weight of each container reliable manual actuation of the locking lever is guaranteed.

Furthermore, the locking lever can have a radial securing projection which brings about the axial fixing of the locking lever in the securing position. Thus, the locking lever can be reliably secured when the securing projection is introduced into a corresponding cut-out.

In one advantageous embodiment of the invention the actuating lever is held pivotably against the securing projection. Correspondingly, the actuating lever is displaced from the radial direction towards the locking lever, and this improves operability. By pivoting the actuating lever can easily be used both in the displacing and in the securing position respectively in order to actuate the locking lever. People with different body sizes can use the actuating lever in the respectively most comfortable position for them.

There can also be provided on the housing a recess, in particular in the form of a groove, into which the actuating lever can be pivoted such that it is held within the outer dimensions of the housing. Therefore, the actuating lever is only pivoted out of the groove in order to establish or break the connection between containers. In the recess the actuating lever is protected from damage and enables normal handling of the individual containers and of the transport units.

Furthermore, the locking lever can be positioned in the support frame of the housing and be actuated through a window in the support frame. In this way the locking lever is protected against damage and unintentional actuation.

Advantageously, there is formed on the window at least one cut-out in which the securing projection can be held in the securing position in order to bring about axial securing of the locking lever. Visibility from the outside enables easy checking of the position of the locking lever. Moreover, the recesses can easily be provided on the window, and further components are not required for the axial fixing of the locking lever.

Locking elements can also be provided in two opposing corner areas in relation to the base area of the container, in the two other corner areas recesses can be provided. Therefore, the opposite sides of the container, by means of which the connection to other containers is established, are formed identically and are exchangeably suitable for connection to an adjacent container. Therefore, connection to the transport units is easily possible without having to take into account a particular configuration or alignment of the container. Moreover, the container can be produced simply and inexpensively since either a locking element or an engagement area is respectively to be provided in every corner area, and redundant connection means are dispensed with.

In a further embodiment of the invention the housing has at least one loading opening which, in the state connected to the transport unit, is located on one of the outer sides of the latter. Thus, any container can also be loaded or unloaded in the connected state. It is advantageous here for reasons relating to symmetry that containers of one overall size have loading openings respectively of the same type and positioned in the same place. Containers which form a transport unit in pairs can be loaded, like conventional sea cargo containers, from the face side of the transport unit. In particular, loading of a container can be provided through another one. When using containers with a small internal height, it is difficult walk within the container, and so it is easier to load from the long sides of the transport unit.

Furthermore, the at least one loading opening can be closed by a door element, in particular by a hinged door, one or two swinging doors, a sliding door or a roll-up door. Hinged or swinging doors opening outwards offer the advantage that they do not take up any space in the interior, and so the loading volume of the container is not reduced. In contrast, sliding or roll-up doors require a certain amount of space within the container in which they can be accommodated when opened. This area must be separated from the rest of the interior of the container in order to prevent blocking of the door by goods located within the container. Roll-up or sliding doors are suitable, in principle, for loading through from one container to an adjacent one because they do not require any space in the outside area in which they are moved. In particular with loading openings which are provided on the long side of the transport unit, upwardly opening hinged doors are, however, preferred because the latter do not take up any space within the container, and blocking of the loading opening of adjacent containers is prevented.

Advantageously the lower side of the housing is designed to be substantially level. Transportation via roller systems or conveyor belts, as is customary in air cargo traffic, is thus possible without tilting or twisting the container. Since the container is moved passively over the roller systems with its level lower side, slightly different configurations of these systems, as occur in different aircraft types made by different manufacturers or with different airline companies, are of no consequence either.

Forklift pockets can also be provided in the base area. Forklift trucks are widely used, efficient transport devices which enable simple transportation of containers and transport units. Depending on the configuration of the containers, an individual container and/or a plurality of containers can be transportable as a transport unit by a forklift truck. Accordingly, the forklift pockets are to be provided such that they are positioned on the long side of the container or the transport unit in order to guarantee secure transport. In particular, the forklift pockets can be fastened to the support frame, and this guarantees high stability. The forklift pockets for the transportation of an individual container can partially correspond to those for the transportation of a transport unit. However, a configuration with forklift pockets both on the longitudinal and on the lateral sides of the container is also possible so as to guarantee the secure transportation both of an individual container and of a transport unit made up of a number of containers.

In a further embodiment of the invention the container can be produced from aluminium, an aluminium alloy or reinforced plastics. These materials have an excellent stability to weight ratio, and so the empty weight of the container remains low. This is particularly advantageous for air transport.

Finally, the container can be in the form of a refrigerated container. For this purpose the container is insulated with an insulating layer and equipped with a cooling unit. Therefore, the transportation of easily perishable food, for which rapid transport is particularly important, is also possible. Since the container already has increased stability in comparison to a special air cargo container, the increase in weight due to the insulating layer and the cooling unit is only small percentagewise. A container purely for air cargo requires additional reinforcement for use as a refrigerated container, and these are dispensed with in the containers according to the invention.

Figure 2:
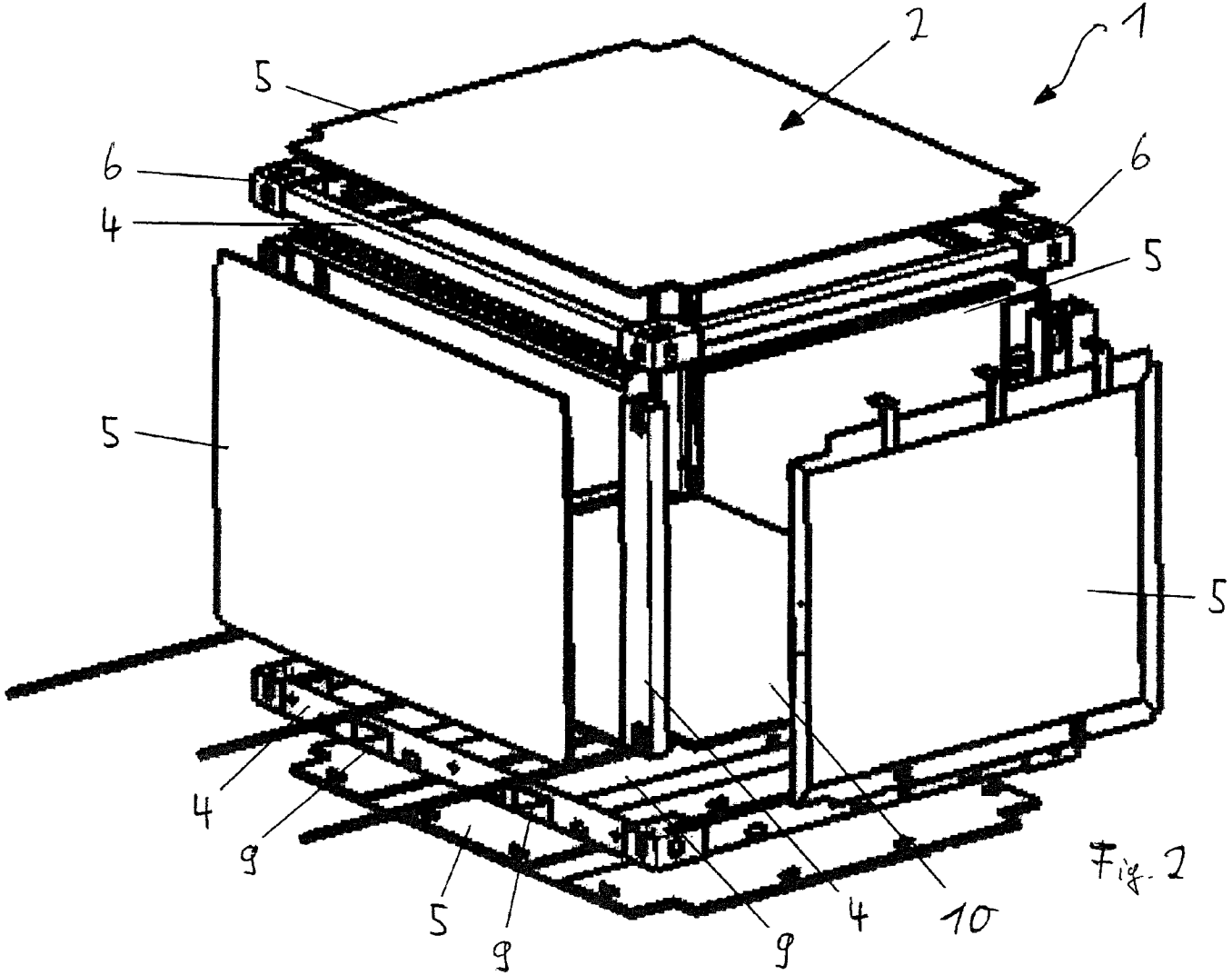
Figure 3:
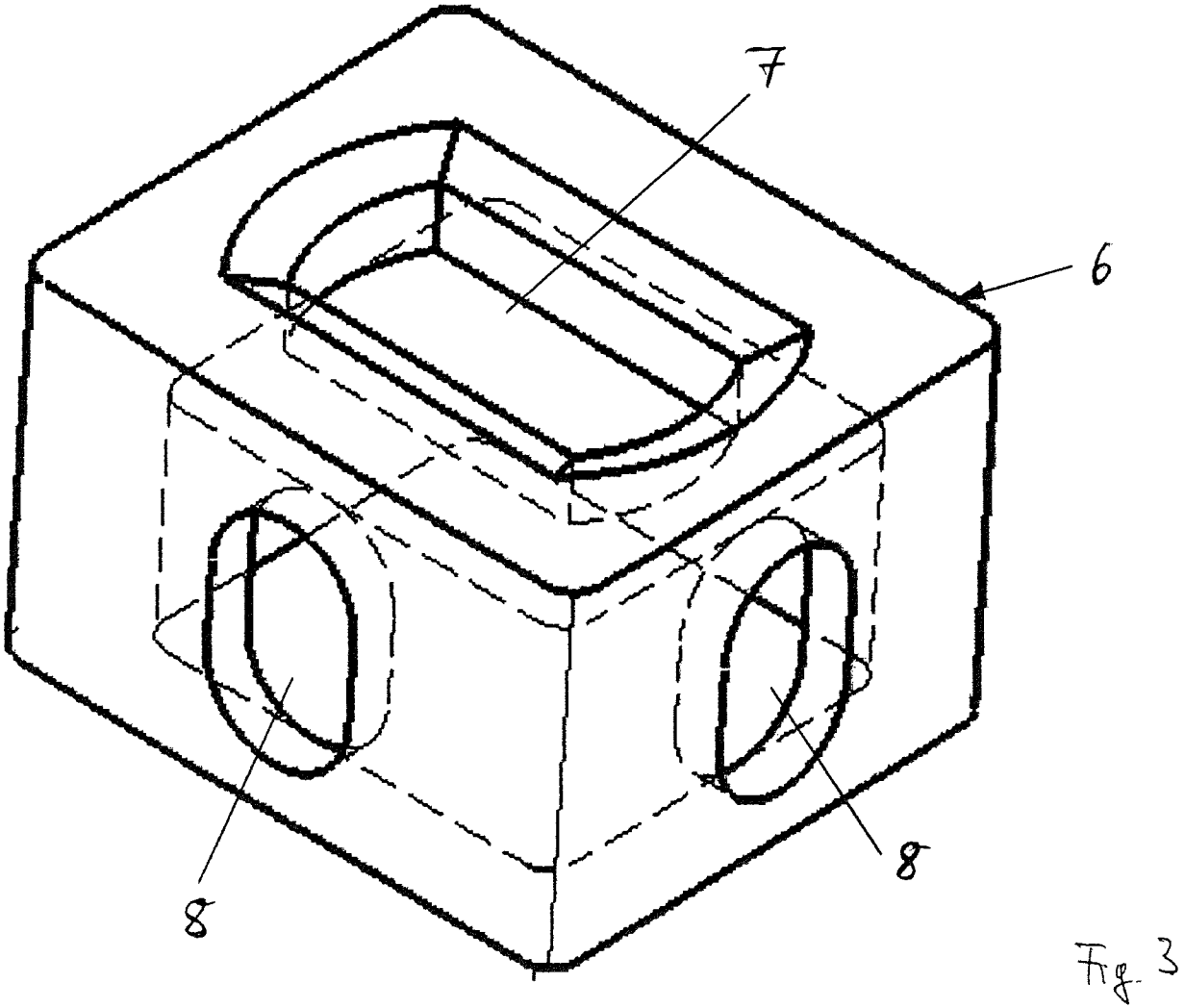
Figure 4:
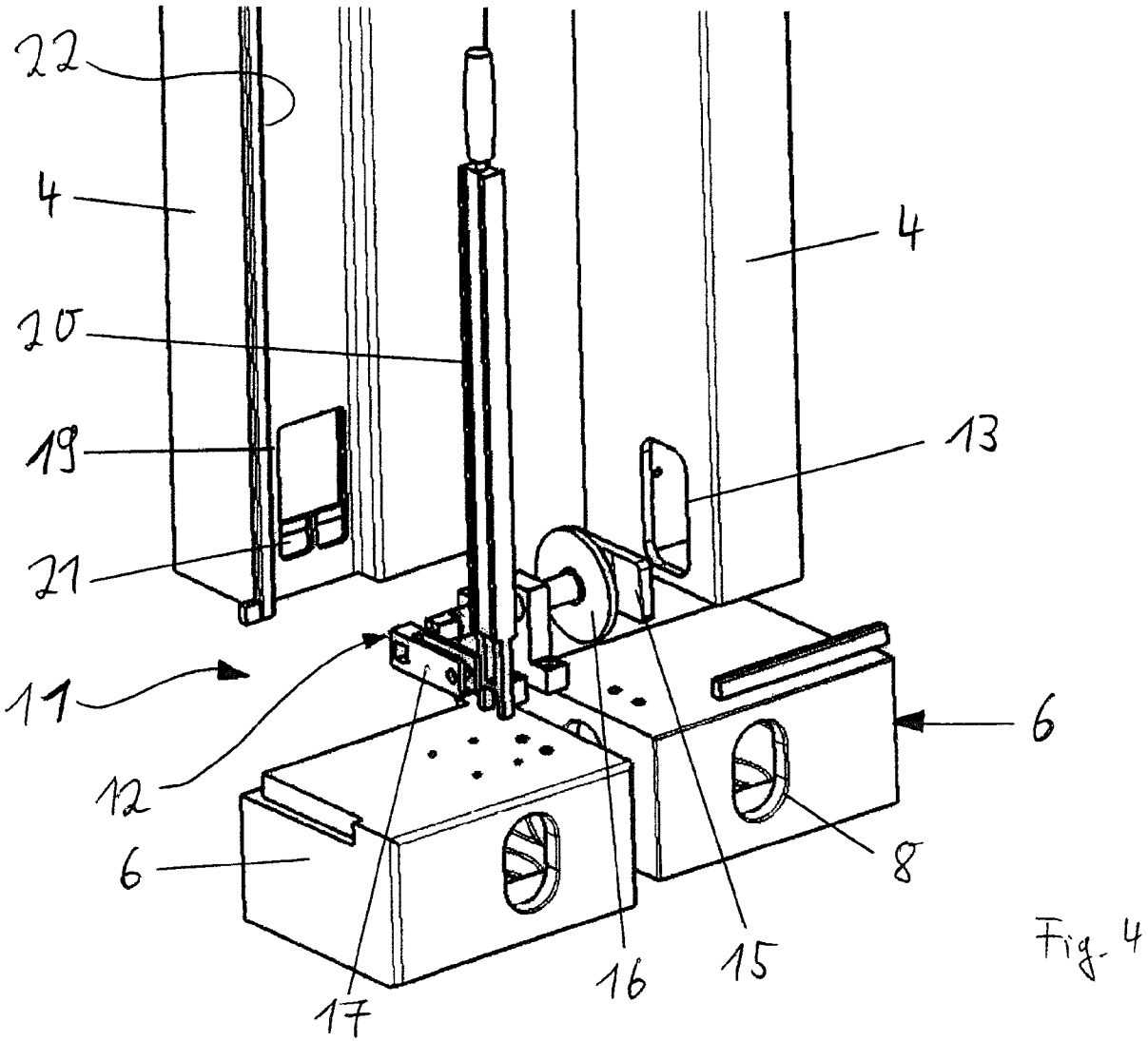
Figure 5:
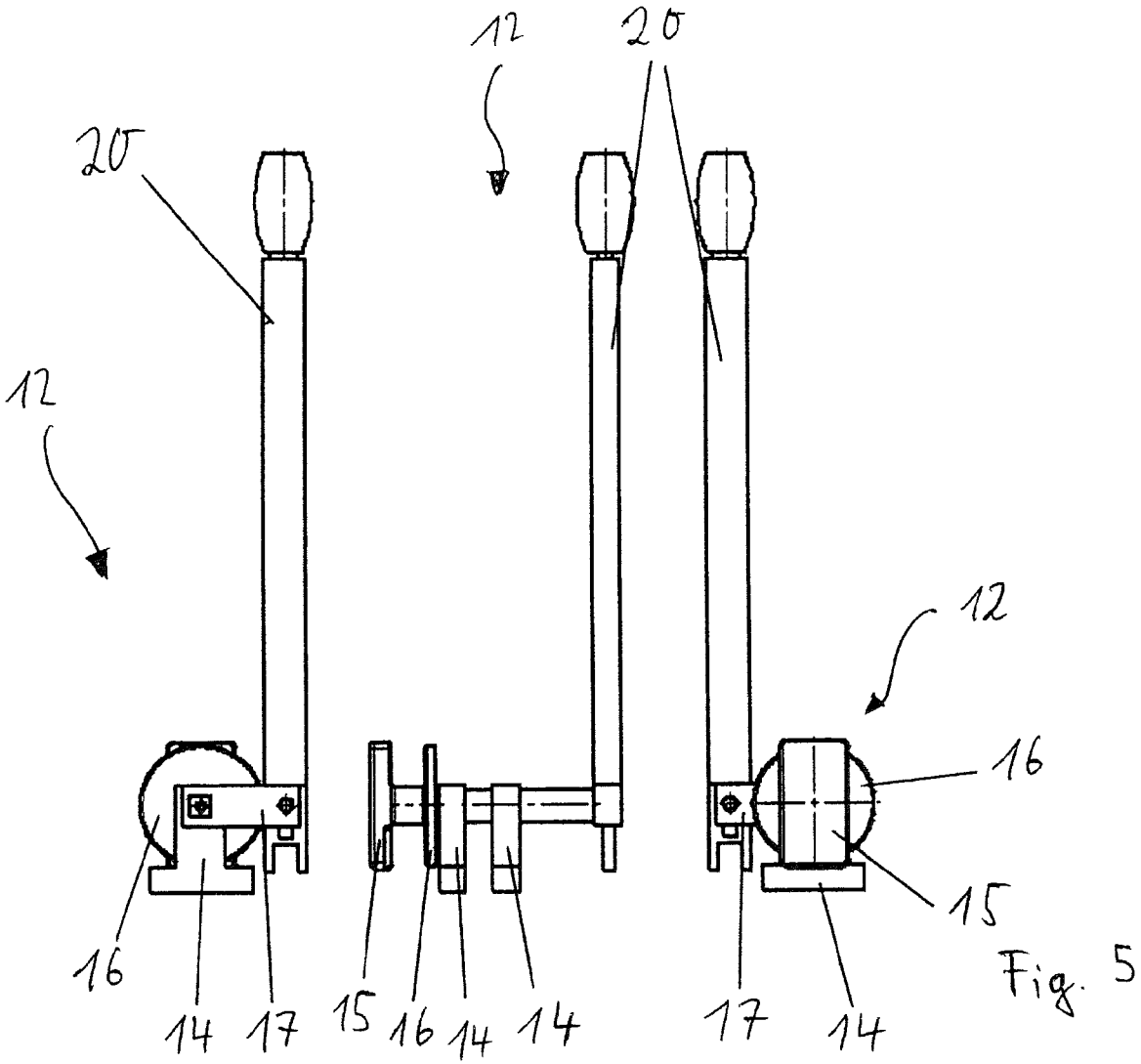
Figure 6:
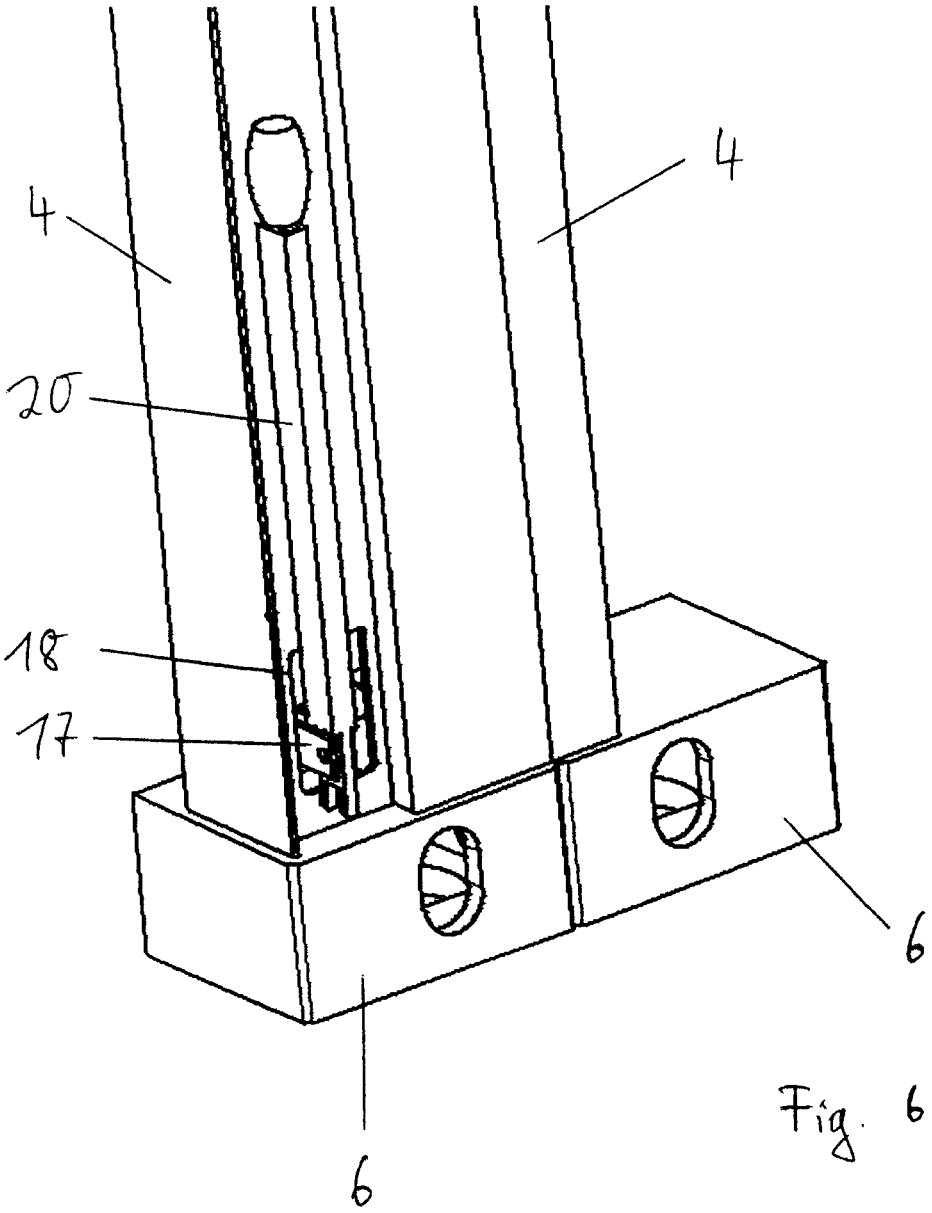
Figure 7:
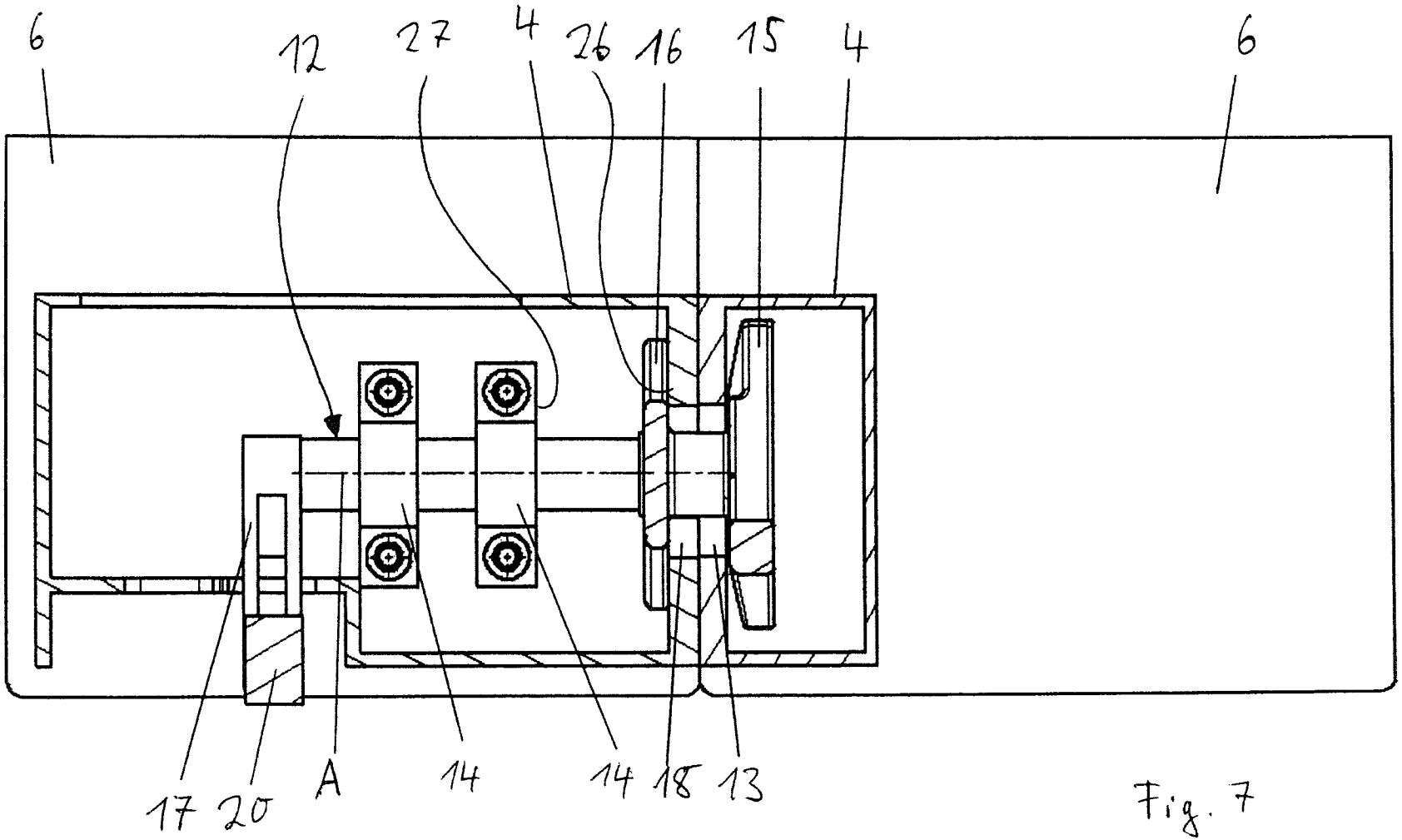
Figure 8:
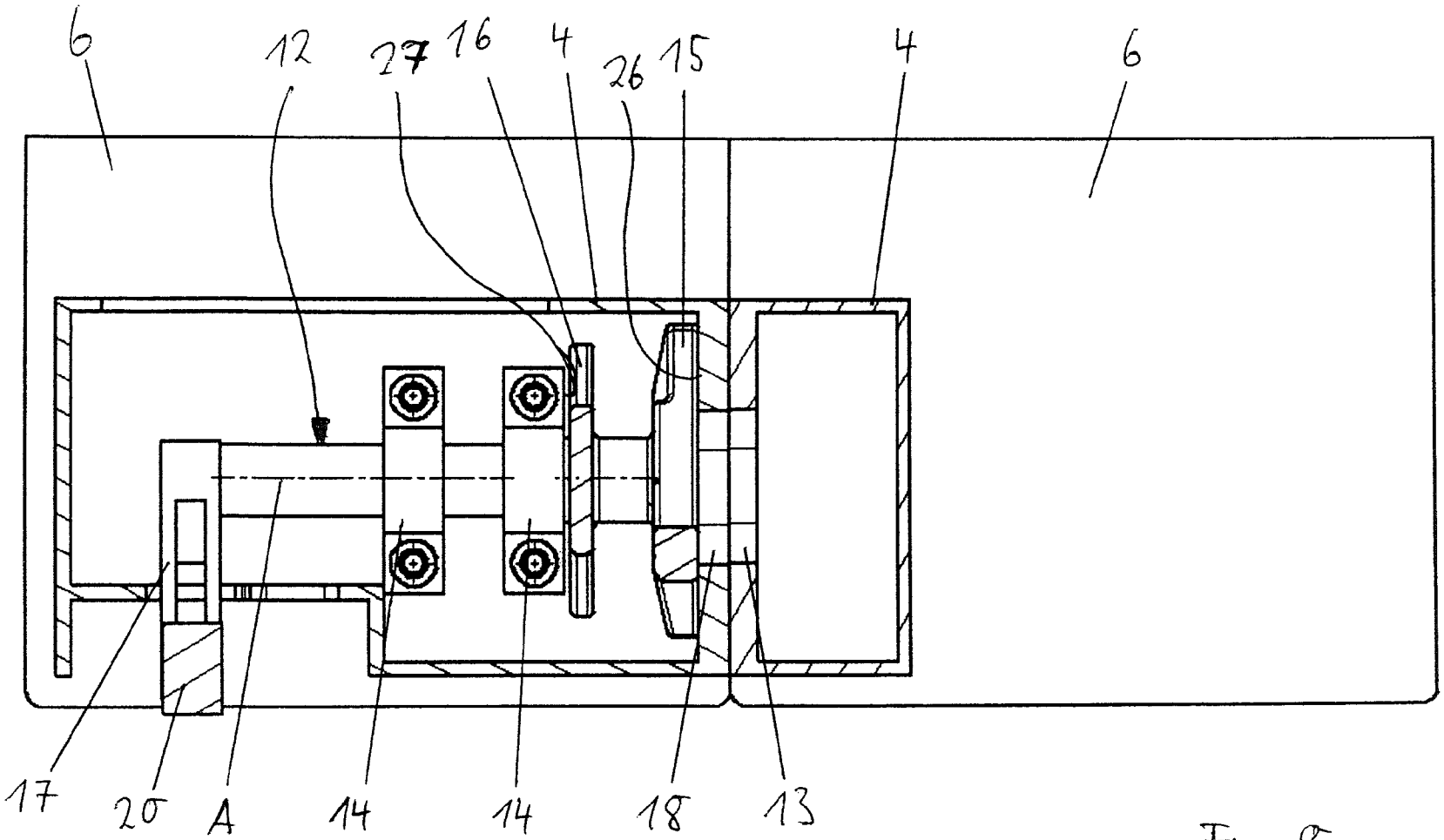
Figure 9:
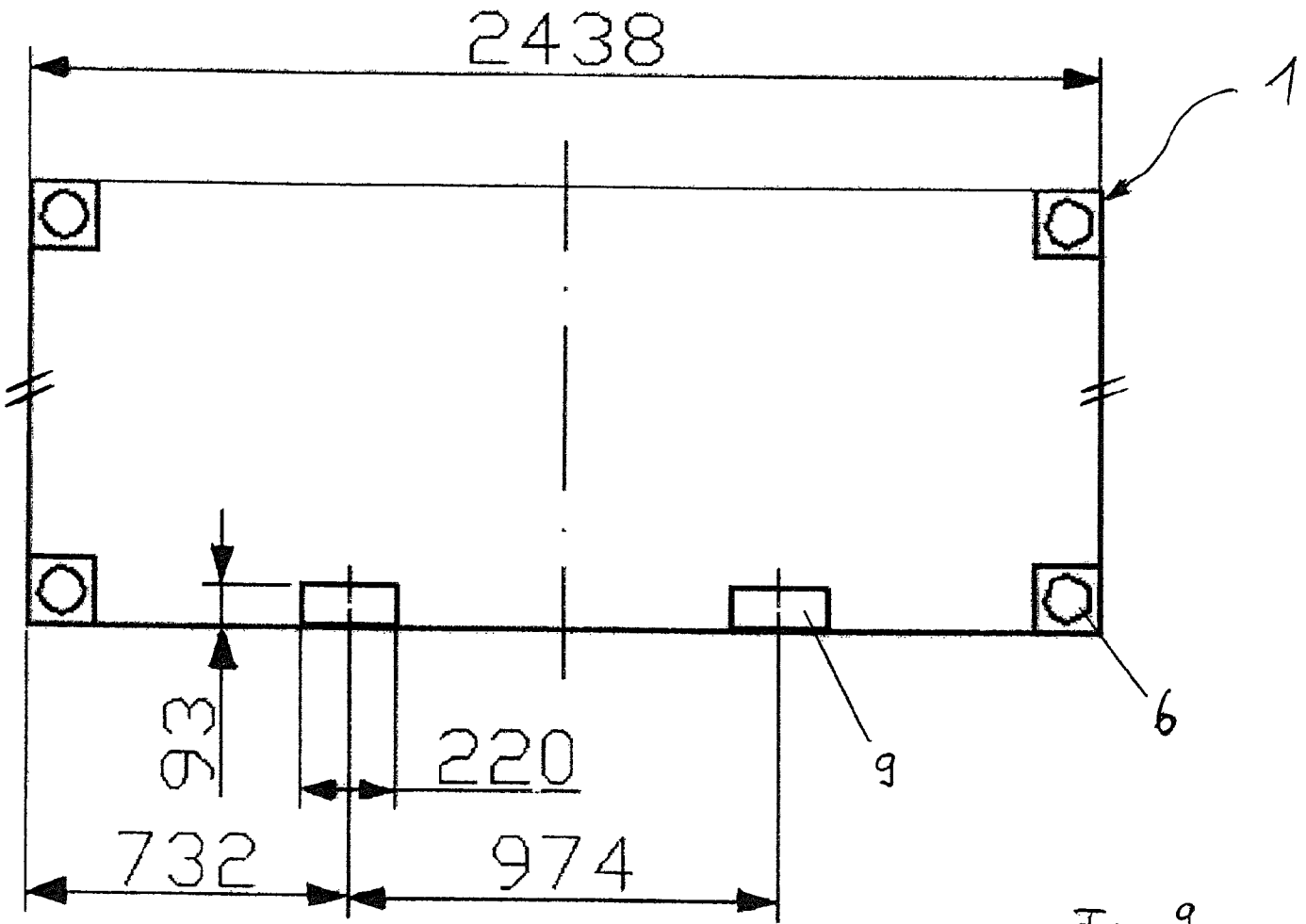
Figure 10:
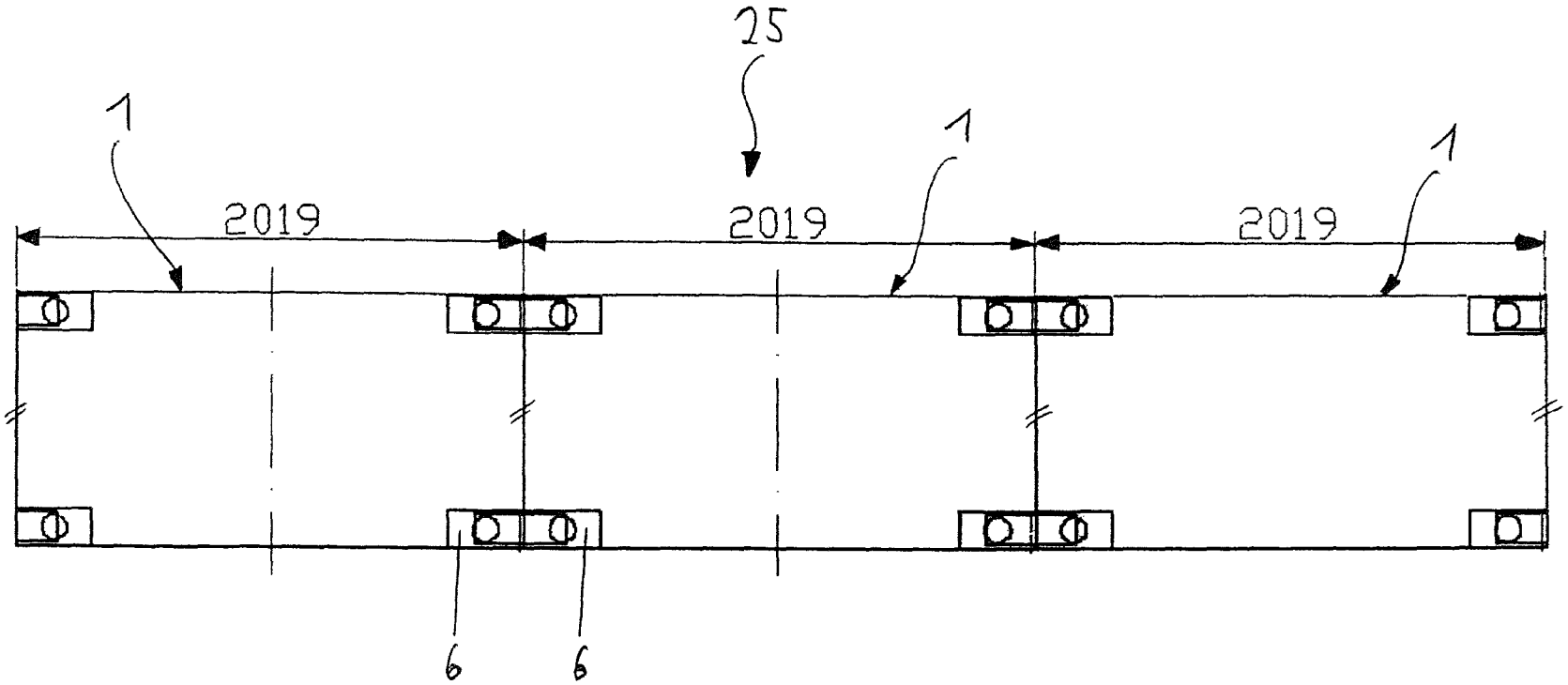
Figure 11:
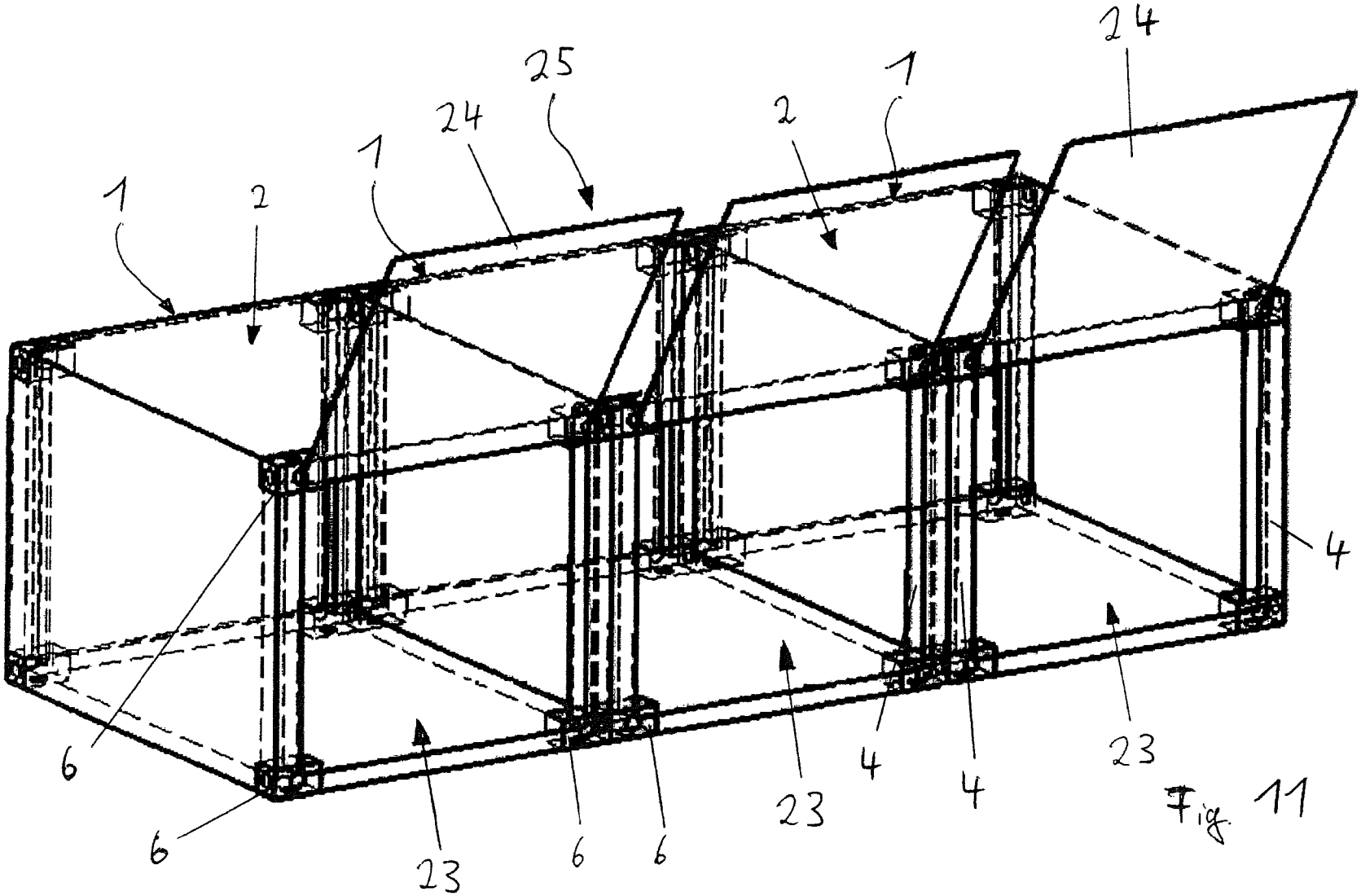
Figure 12:
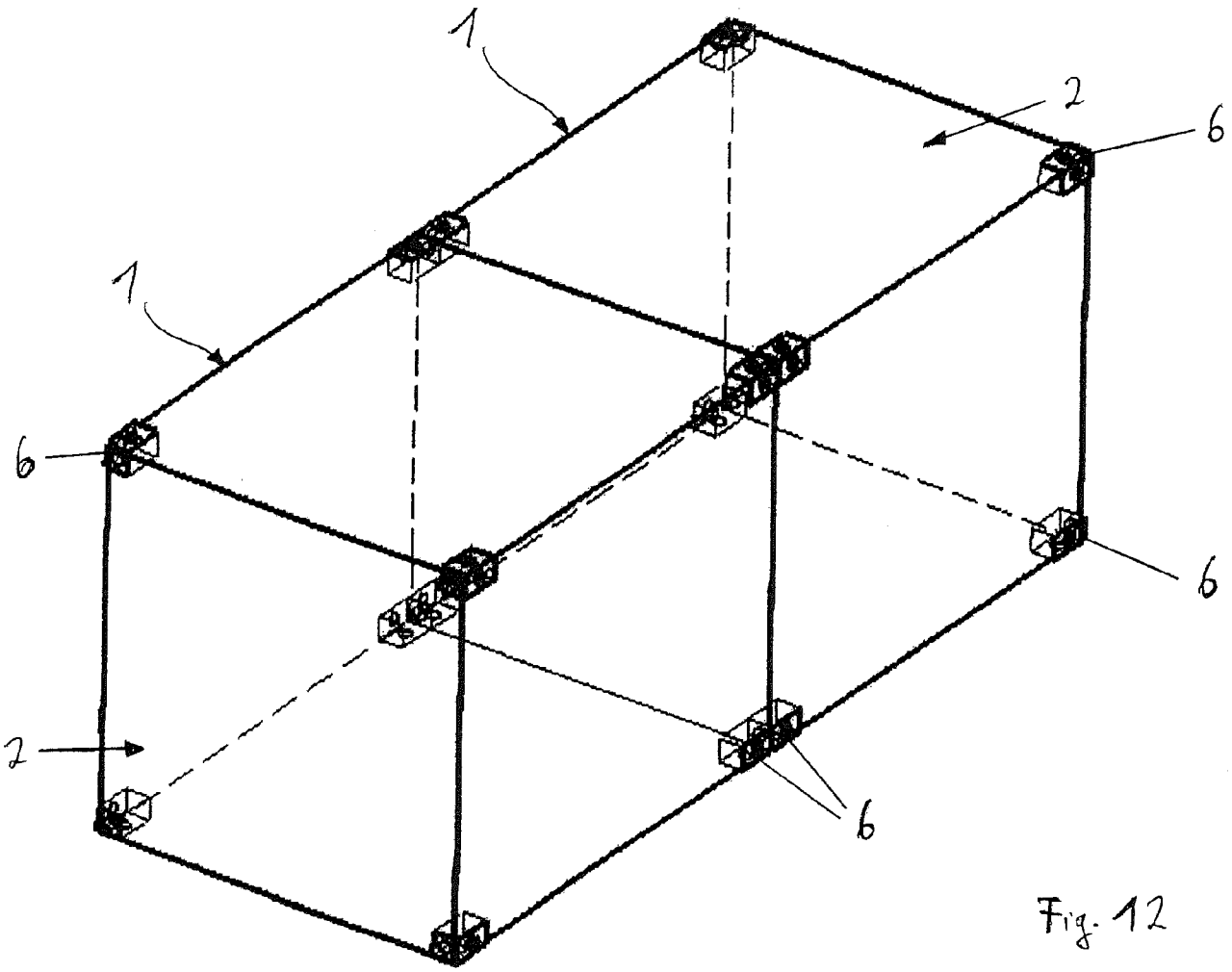
Figure 13:
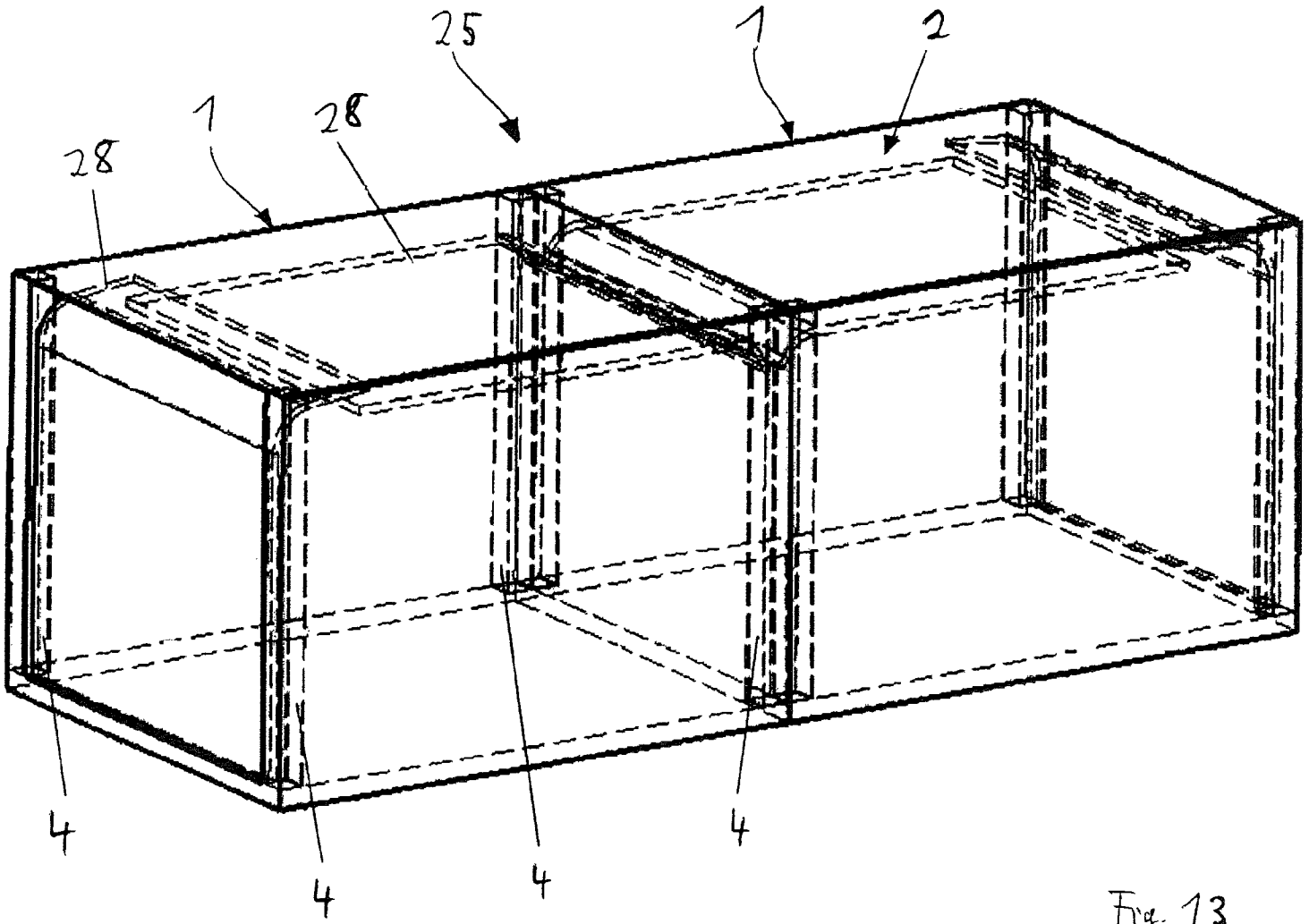
Figure 14:
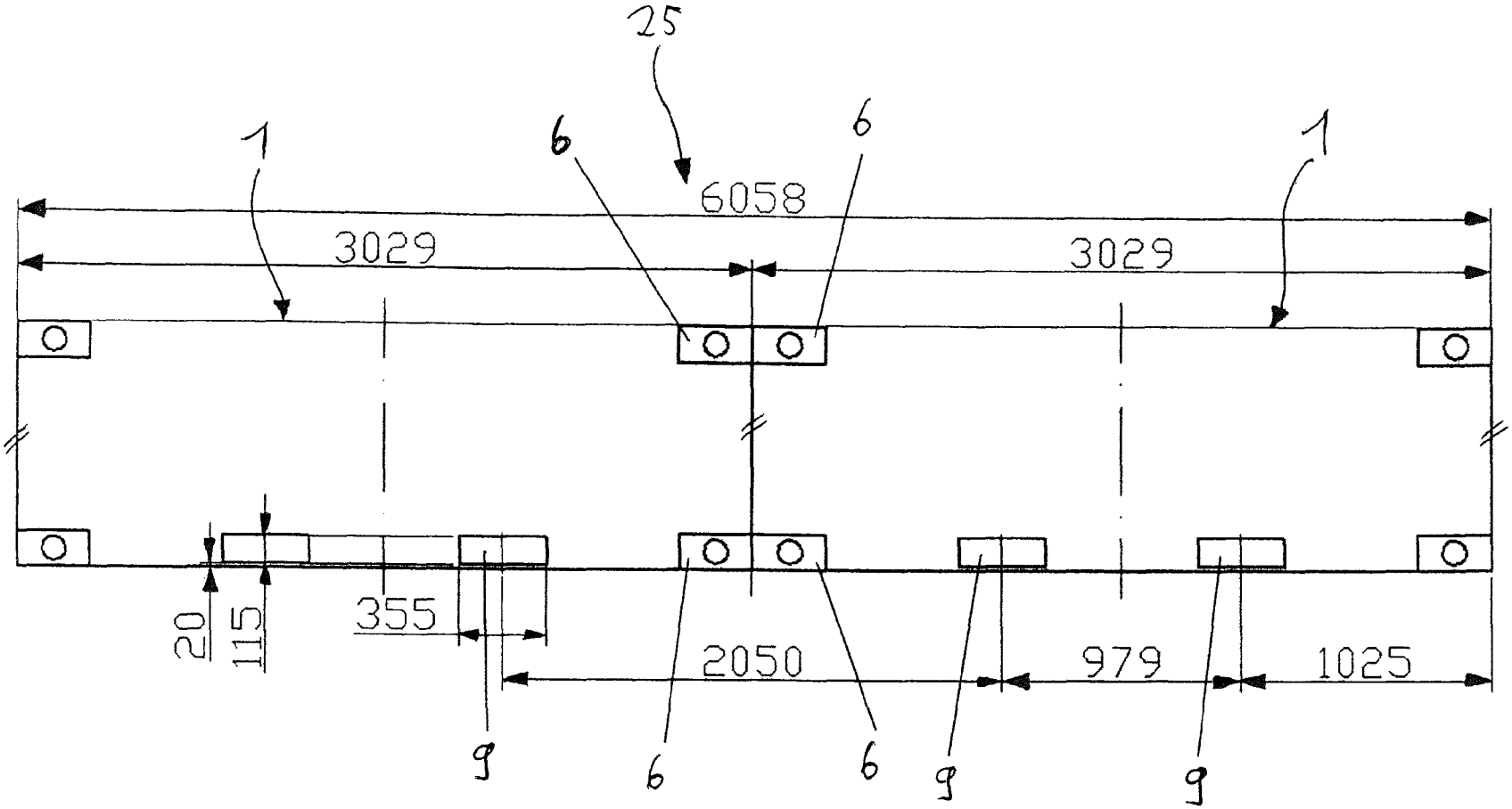
Figure 15:
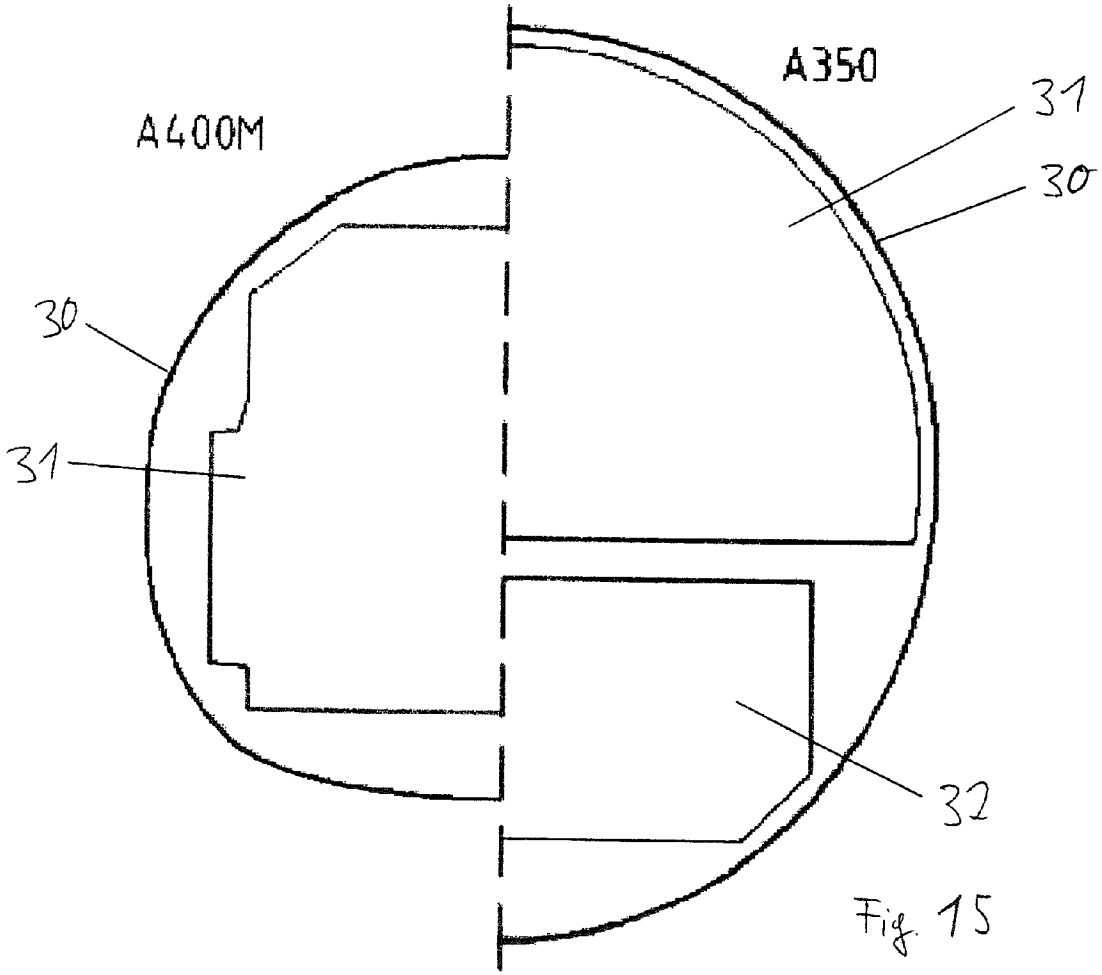
Figure 16:
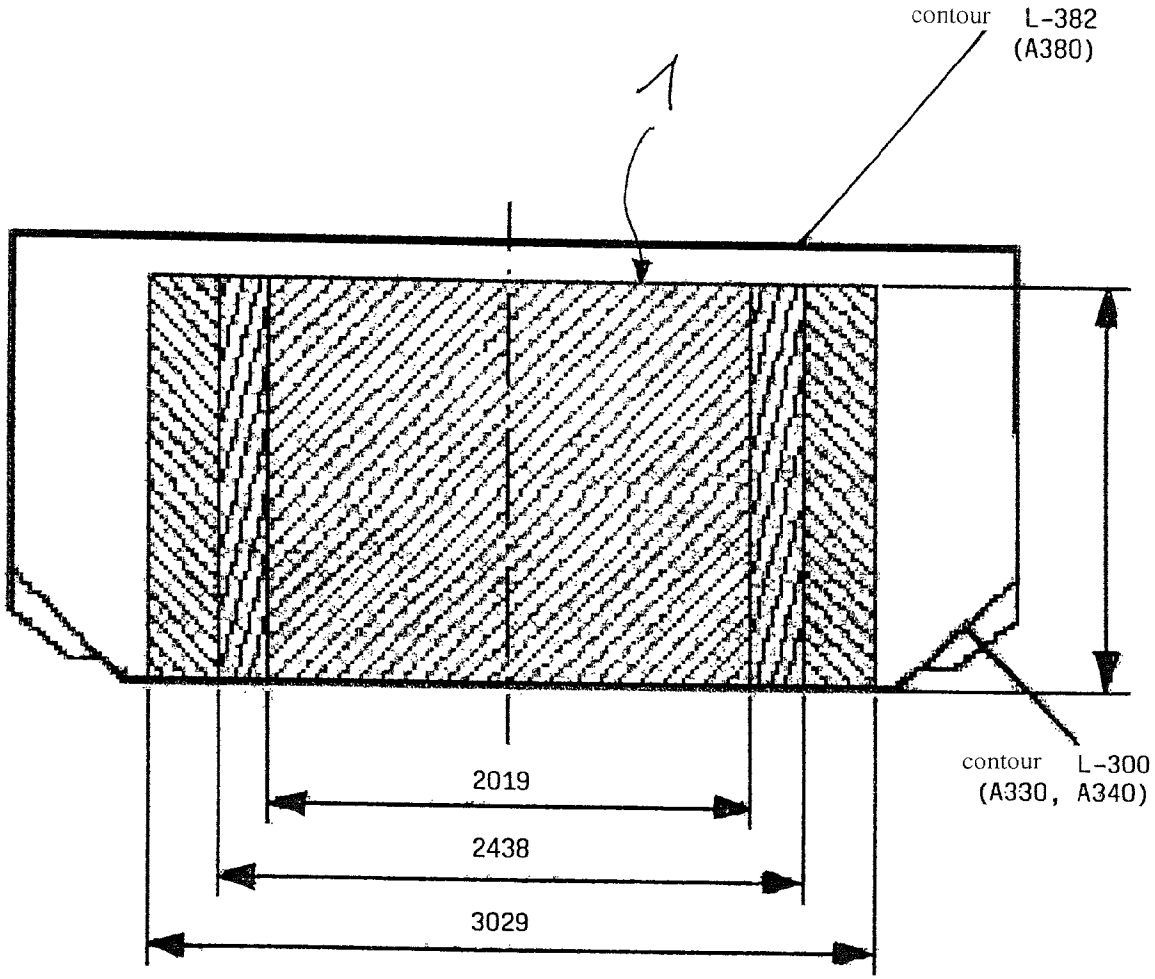
Figure 17:
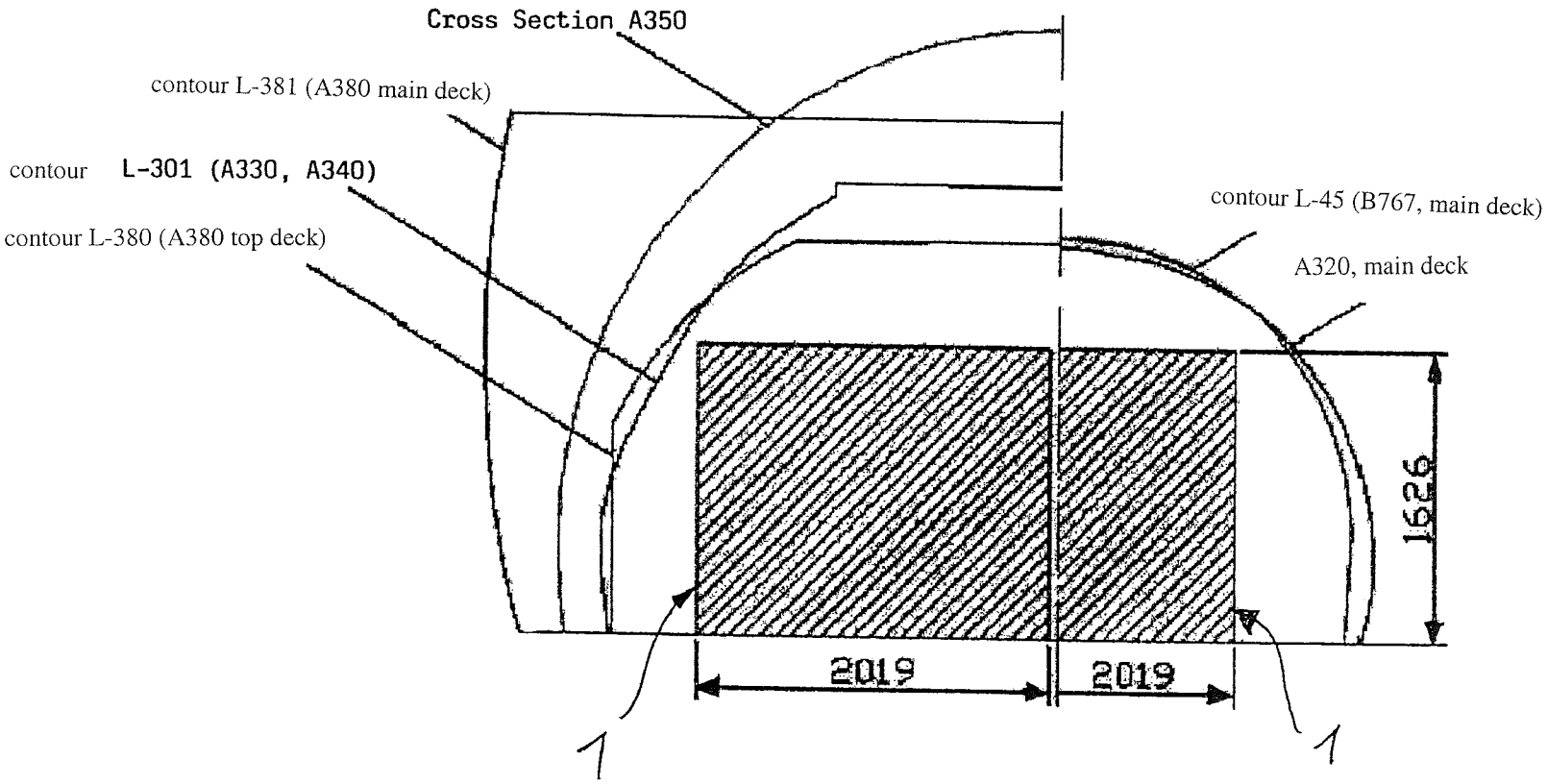
Figure 18:
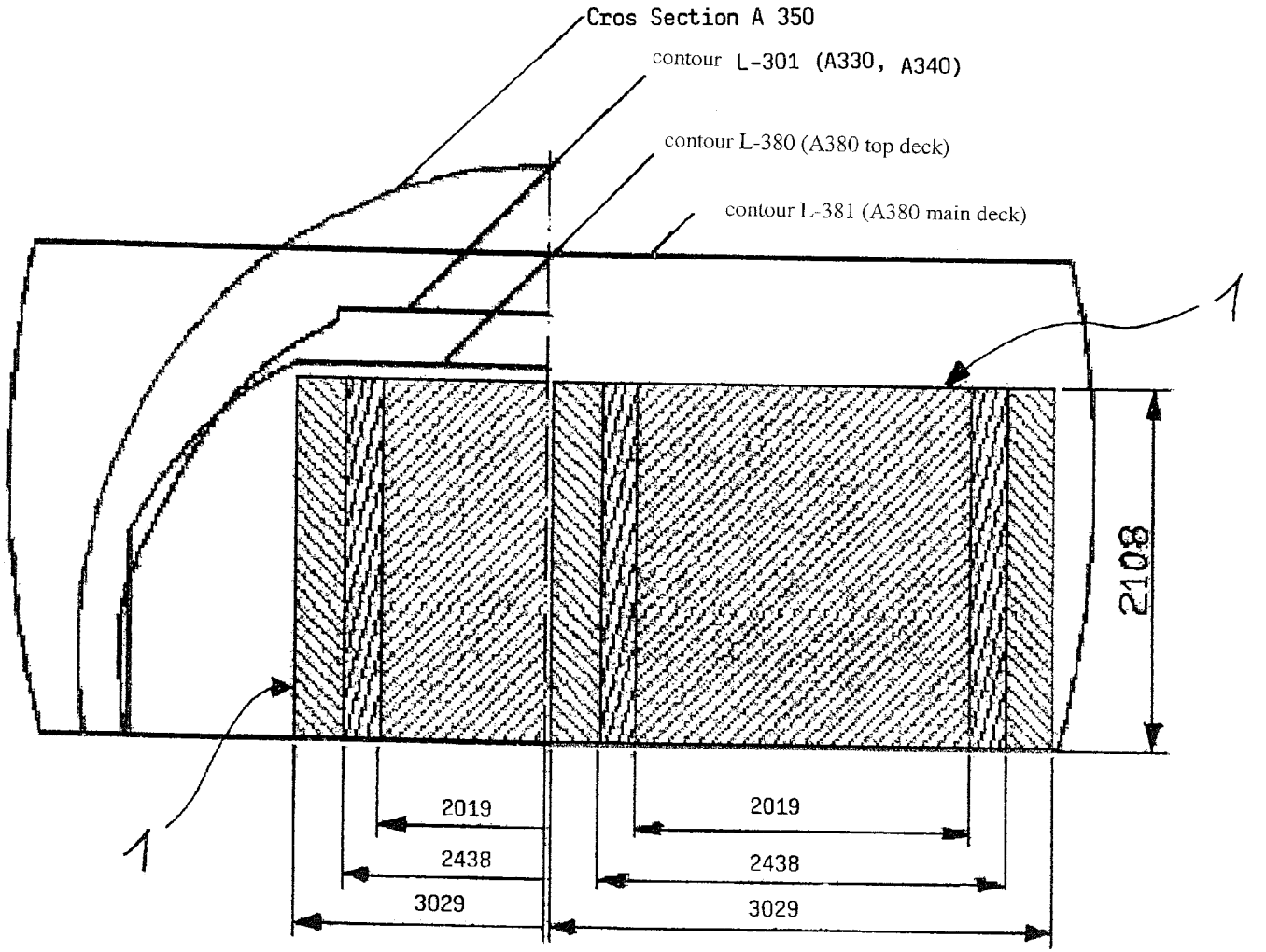

With regard to further embodiments of the invention reference is made to the sub-claims and to the following description of exemplary embodiments with reference to the attached drawings. The drawings show as follows:

FIG. 1 a perspective illustration of a container according to a first embodiment of the present invention, FIG. 2 an exploded illustration of the container from FIG. 1, FIG. 3 a corner casting of the container from FIG. 1, FIG. 4 a perspective exploded view of corresponding connection means of two containers from FIG. 1, FIG. 5 a view in three perspectives of the locking lever from FIG. 4, FIG. 6 a perspective view of the connection means from FIG. 4 in the securing and individual position, FIG. 7 a top view of the connection means from FIG. 4 in the connection position, FIG. 8 a top view of the connection means from FIG. 4 in the individual position, FIG. 9 a frontal view of the container from FIG. 1 with forklift pockets provided on the latter, FIG. 10 a side view of three containers shown in FIG. 1 which are shown with reduced height and in the state combined to form the transport unit, FIG. 11 the three containers combined to form the transport unit from FIG. 10 with hinged doors provided diagrammatically on the latter, folded up, FIG. 12 a perspective, diagrammatic illustration of two containers combined to form one transport unit according to a second embodiment of the present invention, FIG. 13 a perspective, diagrammatic illustration of the containers from FIG. 12 with diagrammatically illustrated roll-up doors provided on the latter, FIG. 14 a side view of the containers from FIG. 12, which are shown with reduced height, forklift pockets being provided on the containers, FIG. 15 a cross-sectional view of the body of an A350 or an A400M with flight decks drawn in, FIG. 16 a sectional view of the lower deck of an A380 with a container introduced into the latter, FIG. 17 a sectional view of different flight decks of different aircraft types with containers accommodated within the latter, and FIG. 18 a sectional view of different flight decks of different aircraft types with containers accommodated within the latter.

FIG. 1 shows a container 1 according to the invention according to a first embodiment of the present invention. The container 1 which is 2019 mm wide, 2438 mm long, and 1626 mm high, comprises a housing 2 with a support frame 3 which is formed from a plurality of profile bars 4 connected at the corners of the housing and plate-shaped wall elements 5 held on the support frame 3. The plate-shaped wall element 5 on the lower side of the container 1 is held on the support frame 3 such that the lower side of the housing forms a level base. The support frame 3 and the wall elements 5 are respectively produced from aluminium, an aluminium alloy or a reinforced plastic so that they have great strength and a low weight.

There are provided on the corners of the housing 2 corner castings 6 which are connected to the adjacent profile bars 4. This type of corner casting 6 is shown separately in FIG. 3 and has on its side lying on the top here an elongate retainer 7 for the stacking of other containers 1. There are provided on the side surfaces slots 8 through which attachment means, for example tension belts, (not shown here), can be passed, by means of which the container 1 can be locked in place during transportation.

In the base area the container 1 has forklift pockets 9 which extend between its long sides between opposing profile bars 4. The forklift pockets 9 are designed according to standard ISO 1496. This corresponds to the normal standard for use with forklift trucks. The container 1 is thus to be transported securely by a forklift truck (not shown). A base plate 10 covers the forklift pockets 9 so that the container has a level inner base.

Furthermore, connection means 11 are provided in order to connect to one another two containers 1 positioned next to one another, as shown in FIG. 4. They comprise as a locking element a substantially cylindrical locking lever 12 which is held on the one housing 2 in a profile bar 4, and an elongate recess 13 which is formed in the other housing 2 in an opposing profile bar 4.

The locking lever 12 can be displaced in the longitudinal direction with two guide elements 14 which are attached to a corner casting 6, and is held rotatably about its longitudinal axis A. On its end facing towards the container 1 to be connected an engagement element 15 in the form of an elongate end plate is provided on the locking lever 12. The end plate 15 is formed and positioned such that it can be introduced into the recess 13 of the container 1 to be connected. Furthermore, a plate-shaped stop element 16 is provided on the locking lever 12 spaced apart from the end plate 15. The distance between the stop element 16 and the end plate 15 corresponds approximately to the distance between the insides of the opposing profile bars 4 of the housings to be connected. A securing projection 17 is formed on the inwardly lying axial end of the locking lever 12. The locking lever 12 is accommodated within the profile bar 4 such that the end plate 15 can be passed through an opening 18 the dimensions of which substantially correspond to those of the recess 13 and which is positioned to correspond with the recess 13.

The securing projection 17 can be actuated by an actuating lever 20 through a window 19 formed in the profile bar 4. In addition there are provided on the lower end of the window 19 two U-shaped cut-outs 21 for accommodating the securing projection 17 and in which the securing projection 17 brings about axial fixing of the locking lever 12. The actuating lever 20 is held pivotably on the securing projection 17, and when the securing projection 17 lies in one of the cut-outs 21, it can be pivoted upwards such that it comes to lie in a recess 22 in the form of a groove in the profile bar 4 of the housing on which the locking lever 12 is held, and is totally accommodated within the latter.

The locking means 11 described are respectively formed to connect the housing 2 on its long side, there being provided in two corner areas diagonally opposing in relation to the base of the container 1 locking levers 12, and in the two other corner areas recesses 13. Locking levers 12 and recesses 13 are located in the upper and lower region of each corner of the housing 2, but do not have to be designed to correspond to one another. It is only crucial that the long sides of the housing 2 to be connected are identical in form.

On its short sides the container 1 has loading openings 23 which can respectively be closed by a flap 24, as shown diagrammatically in FIG. 11. The flap 24 is held pivotably on the housing 2 in a way not shown in detail here. Likewise, securing means (not shown) are provided with which the flap 24 can be closed.

Adjacent containers 1 can be combined easily to form a transport unit 25 as shown in FIGS. 10 and 11. For this purpose the containers 1 are positioned with their long sides next to one another. Since the long sides are respectively identical in form, adjacent containers 1 can be connected to one another in any alignment. For this purpose the actuating lever 20 is first of all pivoted out of the groove 22. The locking lever 12 is then turned by the actuating lever 20 into its adjusting position in which it can be axially displaced. With the axial displacement the end plate 15 is displaced through the recess 13 into the connection position in which it is turned by a rotation of the locking lever 12 so that it engages behind the profile bar 4 and brings about locking of the housings 2 of the adjacent containers 1 to be connected. The stop element comes into contact here with the inner wall of the profile bar 4 surrounding the opening and which forms a first stop surface 26. By rotating the locking lever 12 the securing projection 17 is at the same time introduced into the cut-out 21 lying next to the housing to be connected, and is thus axially secured. Finally the actuating lever 20 is pivoted into the groove 22 so that it is totally accommodated within the latter. The release of the connection between two containers 1 is brought about by reversing the aforementioned steps. The actuating lever 20 is pivoted out of the groove 22 and the locking lever 12 is turned into its adjusting position. The displacement path of the locking lever 12 is restricted by the guide element 14 adjacent to the stop element 16 and of which the side facing towards the stop element 16 forms a second stop surface 27. In this position, which corresponds to an individual position, the locking lever 12 is totally accommodated within the housing 2. The securing projection 17 is then turned into the cut-out 21 spaced apart from the container 1 to be connected, and secured axially. Finally the actuating lever 20 is pivoted into the groove 22.

According to the first embodiment, by combining three containers 1 the transport unit 25 is formed which is 6058 mm long and 2438 mm wide. This corresponds to the standard dimensions of a 20 foot sea cargo container according to ISO 668. This transport unit 25 is therefore suitable for transport both on water by ship and also on land by lorry or train. With the corner castings 6 further transport units 25 or standard sea cargo containers can be stacked as usual. The number of possible units to be stacked is not restricted functionally, but only by the stability of the containers 1.

FIGS. 12 to 14 show a container 1 according to a second embodiment of the present invention. Essential parts correspond with those of the container 1 of the first embodiment, and so the same reference numbers are used for these parts. Only differing components are described again in detail.

The container 1 is 3029 mm long and 2438 mm wide. It is 2108 mm high. Unlike the container 1 of the first embodiment the containers 1 of the second embodiment are connected to one another by their short sides. This produces therefore the base area of the transport unit 25 which is also 6058 mm×2438 mm, and this corresponds to the dimensions of the 20 foot sea cargo container according to ISO 668.

The containers 1 are designed with castings 6 on their corners, as are also used according to the first embodiment. Likewise here, connection means 11, not explicitly shown, are provided which correspond to the first embodiment.

There are applied in the base area of the container 1 forklift pockets 9 which extend here between the long sides of the container 1. They are arranged centrally along the long side of the container 1 979 mm apart from one another in relation to their central plane. With the transport unit 25 the central forklift pockets 9 are spaced apart by 2050 mm in relation to their central plane so that, in accordance with standard ISO 1496, both individual containers 1 and the transport unit 25 can be transported as a whole with a forklift truck. In the latter case the forklift truck engages in a forklift pocket 9 of each container 1.

The container 1 of the second embodiment has on its short sides loading openings 23 which can be closed by roll-up doors 28. The roll-up doors 28 can be sunk into the housing 2 such that they can be positioned over one another along its upper side so that they can be opened without needing any clearance in front of the container 1. In the state connected to the transport unit 25 it is possible to load one container 1 through another container 1. Loading from the short side is also normal with standard sea cargo containers, and so existing logistics devices can be used.

Both the container 1 of the first embodiment and that of the second embodiment can be designed as refrigerated containers in a way not shown here. For this purpose the container 1 is insulated on the inside and is equipped with a cooling unit. Since these changes are only implemented within the container 1, they can be used as usual.

In FIGS. 15 to 18 cross-sections of different aircraft bodies 30 and flight decks 31, 32, 33 of different aircraft are shown. FIG. 12 shows the structure, which is different in principle, of the planned A400M and A350 type aircraft. Whereas the A400M only has a main deck 31, with the A350 a main deck 31 and a lower deck 32 with different dimensions are provided. The A380 is currently the only aircraft to additionally have a continuous upper deck 33, once again with different dimensions.

The lower deck 32 has a small height, and so is particularly suitable for containers 1 with a height of 1626 mm, as shown in FIG. 13. Due to the width of the lower deck 32 shown, in the A330, A340 and A380 models the containers 1 of the first embodiment can be used without any problem both crosswise and in the longitudinal direction. The use of containers 1 according to a third embodiment, which correspond to those of the second embodiment with a height reduced to 1626 mm, is also possible.

For use on the main deck 31 there is a wide range of possibilities as regards the use of different containers 1. As shown in FIG. 14, the containers 1 of the first embodiment can in principle be used in all of the aircraft types shown. In the B767 and A320 type aircraft however, only one of these containers 1 respectively fits width-wise onto the main deck 31, whereas two containers 1 can be positioned next to one another on the main deck 31 in A330, A340, A350 and A380 type aircraft. Moreover, in the A380 two of these containers 1 can be accommodated next to one another on the upper deck 33.

FIG. 15 shows the possibilities for using the containers 1 according to the second embodiment. The A380 can accommodate two of these containers 1 crosswise next to one another on the main deck 31, whereas with the A330, A340 and A350 types respectively only one such container 1 can be positioned crosswise on the main deck 31.

Overall the containers 1 according to the present invention can be used for transport with different aircraft types. A container system with a few different containers 1 is sufficient in order to meet the requirements of the plurality of different aircraft. Here all of the containers 1 of this container system are also extremely suitable for transport by other modes of transport.

The invention claimed is:

1. A container (1) for intermodal transport by air, ship, train and/or motor vehicle, comprising a block-shaped housing (2), wherein there are provided at the corners of the housing (2) castings (6) which are used for positioning when stacking the container (1) and/or for securing the container (1) during transport, and a plurality of containers (1) can be combined to form transport units (25), the base area of which corresponds to that of a standardised sea cargo container, characterized in that connection means (11) for fastening the housing (2) onto housings (2) of adjacent containers (1) are provided on the housing (2), wherein the connection means (11) comprise locking elements (12) and recesses (13), each locking element mounted on a respective housing (2) via a guide element (14) disposed within the housing such that the locking elements (12) and recesses (13) of containers (1) positioned next to one another can be engaged with one another, and wherein the locking element (12) is in the form of a locking lever which can be moved by rotating about its longitudinal axis between a securing position, in which it is held securely axially, and an adjusting position, in which it can be displaced in the direction of its longitudinal axis with respect to the housing the locking lever is mounted on, and between an individual position, in which it is positioned within the outer dimensions of the housing (2), and a connection position, in which it can be engaged with the recess (13) of the housing (2) of an adjacent container (1), in order to bring about locking with the latter, wherein an actuating lever (20) is provided on the locking lever (12) by means of which the locking lever (12) can be moved, the locking lever (12) has a radial securing projection (17) which brings about the axial fixing of the locking lever (17) in the securing position, and the actuating lever (20) is held pivotably against the securing projection (17), there being provided on the housing (2) a recess (22), in the form of a groove, into which the actuating lever (20) by means of which the locking lever (12) can be moved, can be pivoted such that it is held within the outer dimensions of the housing (2).

2. The container (1) according to claim 1, characterised in that it has a base area of substantially 3029 mm×2438 mm or 2019 mm×2438 mm, and/or that it has a height of substantially 2108 mm or 1626 mm.

3. The container (1) according to claim 1, characterised in that the housing (2) has a support frame (3) and plate-shaped wall elements (5) attached to the latter.

4. The container (1) according to claim 1, characterised in that there is provided on the locking lever (12) an engagement element (15), in particular in the form of an elongate plate, which can be guided in the adjusting position through the recess (13) and engages behind it in the securing position, there being provided in particular on the locking lever (12) a stop element (16) and being positioned such that when it reaches the connection position and/or the individual position it comes to rest against a stop surface (26, 27) in order to restrict the displacement path of the locking lever (12).

5. The container (1) according to claim 1, characterised in that the locking lever (12) is positioned in the support frame (3) of the housing (2) and can be actuated through a window (19) in the support frame (3).

6. The container (1) according to claim 5, characterised in that there is formed on the window (19) at least one cut-out (21) in which a radial securing projection (17), which brings about the axial fixing of the locking lever (17) in the securing position, can be held in the securing position in order to bring about axial securing of the locking lever (12).

7. The container (1) according to claim 1, characterised in that locking elements (12) are provided in two opposing corner areas in relation to the base area of the container (1), and in the other two corner area recesses (13) are provided.

8. The container (1) according to any claim 1, characterised in that the housing (2) has at least one loading opening (23) which can be closed by a door element, in particular by a hinged door (22), one or two swinging doors, a sliding door or a roll-up door (28).

9. The container (1) according to claim 1, characterised in that the lower side of the housing is designed to be substantially level, and/or forklift pockets (9) are provided in the base area of the housing (2).

10. A transport unit (25) for intermodal transport by air and ship, train and/or motor vehicle, the base area of which corresponds to that of a standardised sea cargo container, characterised in that a plurality of containers (1) according to claim 1 are attached to one another such as to form the transport unit (25).

11. A container system for intermodal transport by air and ship, train and/or motor vehicle, characterised in that the container system comprises a plurality of containers (1) and/or transport units (25) according to claim 1.

12. A container (1) for intermodal transport by air, ship, train and/or motor vehicle, comprising a block-shaped housing (2), wherein there are provided at the corners of the housing (2) castings (6) which are used for positioning when stacking the container (1) and/or for securing the container (1) during transport, and a plurality of containers (1) can be combined to form transport units (25), the base area of which corresponds to that of a standardised sea cargo container, characterized in that connection means (11) for fastening the housing (2) onto housings (2) of adjacent containers (1) are provided on the housing (2), wherein the connection means (11) comprise locking elements (12) and recesses (13), each locking element mounted on a respective housing (2) via a guide element (14) disposed within the housing such that the locking elements (12) and recesses (13) of containers (1) positioned next to one another can be engaged with one another, and wherein the locking element (12) is in the form of a locking lever which can be moved by rotating about its longitudinal axis between a securing position, in which it is held securely axially, and an adjusting position, in which it can be displaced in the direction of its longitudinal axis with respect to the housing the locking lever is mounted on, and between an individual position, in which it is positioned within the outer dimensions of the housing (2), and a connection position, in which it can be engaged with the recess (13) of the housing (2) of an adjacent container (1), in order to bring about locking with the latter, wherein the locking lever (12) has a radial securing projection (17) which brings about an axial fixing of the locking lever (17) in the securing position and the locking lever (12) is positioned in the support frame (3) of the housing (2) and can be actuated through a window (19) in the support frame (3), and further wherein there is formed on the window (19) at least one cut-out (21) in which the radial securing projection (17), which brings about the axial fixing of the locking lever (17) in the securing position, can be held in the securing position in order to bring about axial securing of the locking lever (12).

13. The container (1) according to claim 12, characterised in that it has a base area of substantially 3029 mm×2438 mm or 2019 mm×2438 mm, and/or that it has a height of substantially 2108 mm or 1626 mm.

14. The container (1) according to claim 12, characterised in that the housing (2) has a support frame (3) and plate-shaped wall elements (5) attached to the latter.

15. The container (1) according to claim 12, characterised in that there is provided on the locking lever (12) an engagement element (15), in particular in the form of an elongate plate, which can be guided in the adjusting position through the recess (13) and engages behind it in the securing position, there being provided in particular on the locking lever (12) a stop element (16) and being positioned such that when it reaches the connection position and/or the individual position it comes to rest against a stop surface (26, 27) in order to restrict the displacement path of the locking lever (12).

16. The container (1) according to claim 12, characterised in that there is provided on the locking lever (12) an actuating lever (20) by means of which the locking lever (12) can be moved.

17. The container (1) according to claim 12, characterised in that the actuating lever (20) is held pivotably against the securing projection (17), there being provided particularly on the housing (2) a recess (22), in particular in the form of a groove, into which an actuating lever (20) by means of which the locking lever (12) can be moved, can be pivoted such that it is held within the outer dimensions of the housing (2).

18. The container (1) according to claim 12, characterised in that locking elements (12) are provided in two opposing corner areas in relation to the base area of the container (1), and in the other two corner area recesses (13) are provided.

19. The container (1) according to any claim 12, characterised in that the housing (2) has at least one loading opening (23) which can be closed by a door element, in particular by a hinged door (22), one or two swinging doors, a sliding door or a roll-up door (28).

20. The container (1) according to claim 12, characterised in that the lower side of the housing is designed to be substantially level, and/or forklift pockets (9) are provided in the base area of the housing (2).

21. A transport unit (25) for intermodal transport by air and ship, train and/or motor vehicle, the base area of which corresponds to that of a standardised sea cargo container, characterised in that a plurality of containers (1) according to claim 12 are attached to one another such as to form the transport unit (25).

22. A container system for intermodal transport by air and ship, train and/or motor vehicle, characterised in that the container system comprises a plurality of containers (1) and/or transport units (25) according to claim 12.

* * * * *